United States Patent [19]

Briggs

[11] 3,973,501

[45] Aug. 10, 1976

[54] FUZE WITH DUAL SAFE POSITIONS AND ARMED-SAFE INDICATOR

[75] Inventor: George S. Briggs, Adelphi, Md.

[73] Assignee: The United States of America as represented by the Secretary of the Navy, Washington, D.C.

[22] Filed: Sept. 17, 1974

[21] Appl. No.: 506,677

Related U.S. Application Data

[63] Continuation-in-part of Ser. No. 322,825, Jan. 11, 1973, abandoned.

[52] U.S. Cl. ..... 102/81; 102/76 R; 102/81.6

[51] Int. Cl.[2] ..... F42C 5/00

[58] Field of Search ..... 102/70 R, 76, 78–81.6

[56] References Cited

UNITED STATES PATENTS

| | | | |
|---|---|---|---|
| 2,118,062 | 5/1938 | Woodberry | 102/78 |
| 2,913,984 | 11/1959 | Meek et al. | 102/78 X |
| 3,362,332 | 1/1968 | Campagnuolo | 102/81 |
| 3,611,943 | 10/1971 | Popper | 102/86 |
| 3,670,656 | 6/1972 | Donahue et al. | 102/81 |

*Primary Examiner*—Harold Tudor

*Attorney, Agent, or Firm*—R. S. Sciascia; J. A. Cooke; F. K. Yee

[57] ABSTRACT

An explosive-train, arming-rotor type fuze mounted flush with the skin of a weapon wherein the arming rotor is doubly out-of-line in the safe position, and where both linear translation and angular rotation is required to align the explosive train in the armed position. A visual and tactile indicator is provided, the fuze being "safe" when it remains flush, and being able to become "armed" when the fuze protrudes from the skin of the weapon.

17 Claims, 12 Drawing Figures

FUZE WITH DUAL SAFE POSITIONS AND ARMED-SAFE INDICATOR

CROSS-REFERENCES TO RELATED APPLICATION

This application is a continuation-in-part of application Ser. No. 322,825 filed Jan. 11, 1973, now abandoned.

BACKGROUND OF THE INVENTION

The present invention relates generally to ordnance fuzes and more particularly to the explosive-train, arming-rotor type fuze having a dual, out-of-line safe position and providing armed-safe indications.

The function of explosive-train, arming-rotor ordnance fuzes is to keep the readily-initiated detonator separated from the less sensitive booster charge when a fuze or weapon is being stored or handled to avoid premature detonation if the weapon is subjected to an unusual environment or to rough handling.

Various fuzes having rotatable or slidable arming rotors or interrupter have been devised, but they lack the reliability, safety, and armed-safe indication that is desired. For example, the arming rotor in the safety and arming devices forms or contains a component of the explosive train, and in the safe position is held out-of-line, either axially or rotationally. The fuze is then armed by physically aligning the rotor by means of an escapement mechanism activated by a timer, triggered upon ordnance deployment and powered by some form of stored energy, such as a wound spring. The presence of the stored energy is a definite safety hazard, and the arming rotor, with its single, out-of-line safe position can easily be accidently displaced into its armed position. Therefore, for reasons of safety, it is necessary to keep the fuzes separated from the weapons during transportation and handling operations and in storage, rather than being assembled at the manufacturing stage, to avoid possible disasters.

Frequently the weapons would be roughly handled when a ship was provisioned and when a gun or an aircraft was loaded with the weapons. Occasionally, weapons would be subjected to fire and excessive heat. Since existing fuzes are not entirely reliable, they therefore had to be assembled to the weapon in the field, an often difficult task, resulting in loss of time and unnecessary exposure of personnel.

Another consideration for keeping the fuzes and weapons separated until use is that frequently there are no positive indications of the fuze's safe or armed condition when it was installed in the weapon. The armed-safe condition is generally determined by observing the interrupter or a "flag" through a viewing window, but this may be difficult under red-light battle conditions aboard ship. Frequently the armed-safe indicator is concealed, or at best difficult to see, when the fuze is installed on the weapon.

Often indicators did not exist in prior art fuzes, and it was impossible to determine if they were armed or safe, or if they had been poorly assembled or were missing vital parts, except by inspection at the time of assembly or by x-ray techniques later.

SUMMARY OF THE INVENTION

Accordingly, an object of the present invention is to provide an improved ordnance fuze.

Another object of the instant invention is to provide an improved ordnance fuze that is safer and more reliable.

Still another object of the present invention is to provide an ordnance fuze of such safety and reliability in transportation, storage, and handling that it may be installed in a weapon at the manufacturing stage.

A still further object of the present invention is to provide an ordnance fuze whose safe or armed condition may readily be determined by visual and tactile means.

An additional object of the present invention is to provide an ordance fuze which will readily reveal a mal-assembly at manufacture.

A still further object of the present invention is to provide an ordnance fuze that has no stored energy for arming purposes.

Still another object of the instant invention is to provide an ordnance fuze having dual safe positions.

Briefly, these and other objects of the present invention are attained by the use of an explosive-train, arming-rotor type fuze mounted flush with the skin of a weapon. The rotor or interrupter, carrying a portion of the explosive train, is in such a position that the explosive train is doubly out-of-line in the safe position. A linear translation of the rotor, initiated manually, "enables" the fuze in a first out-of-line position, and permits a portion to protrude from the skin of the weapon to sense the airflow in the environment and to provide visual and tactile indication of the "enable" condition. Only when the weapon is launched is the rotor permitted to be rotated from the first, out-of-line "enabled" position to an "armed" position with the components of the explosive train aligned.

BRIEF DESCRIPTION OF THE DRAWINGS

A more complete understanding of the invention and many of its attendant advantages thereof will be readily appreciated as the same becomes better understood by reference to the following detailed description when considered in connection with the accompanying drawings, wherein.

DESCRIPTION OF THE PREFERRED EMBODIMENT

Figure 3:
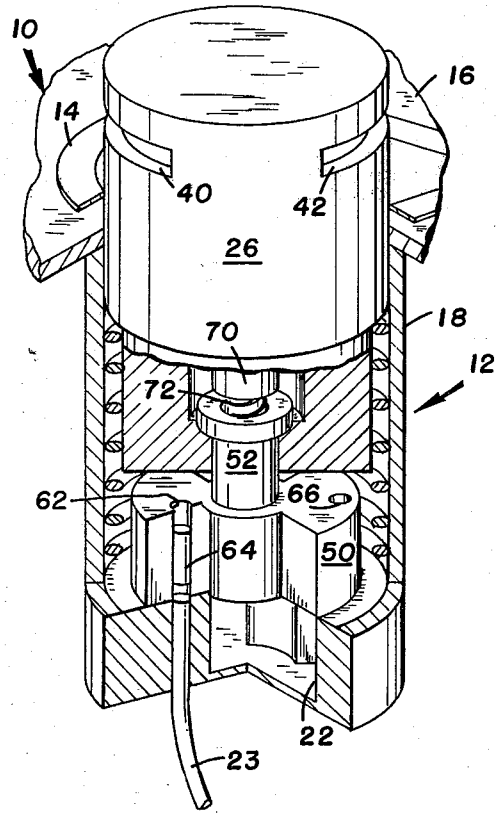
FIG. 3 is an isometric view, partial broken away, of the fuze in the armed position after the environmental sensor has caused the rotor to align the explosive train.
Figure 2:
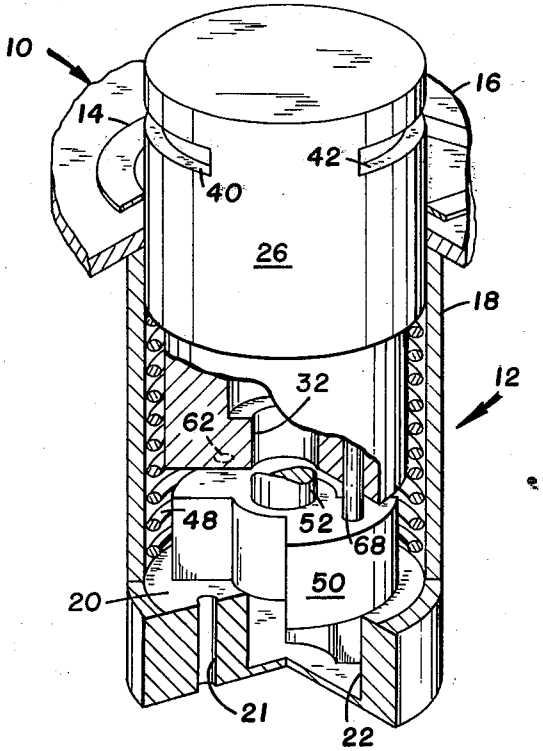
FIG. 2 is an isometric view, partially broken away, of the fuze in the first out-of-line, enabled position, with the environmental sensor projectd into the air stream.
Figure 1:
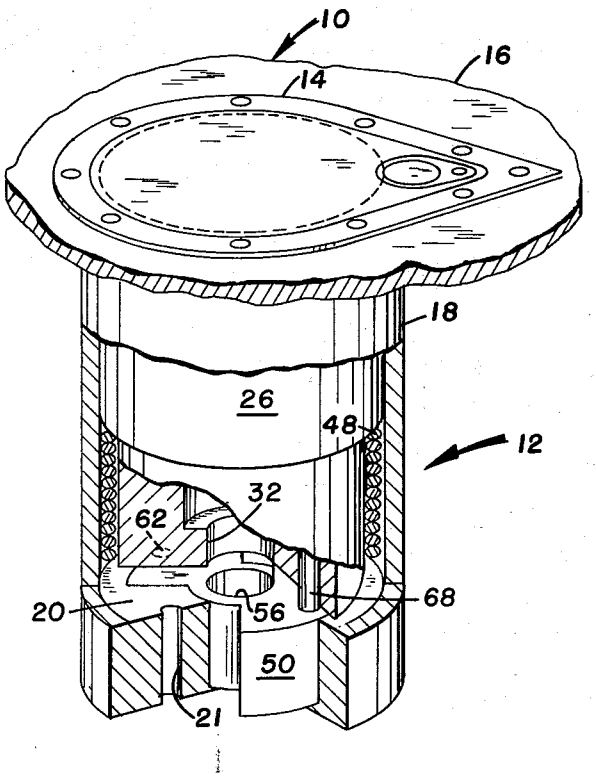
FIG. 1 is an isometric view, partially broken away, of the fuze in the double out-of-line, safe position, with the environmental sensor flush with the skin of the weapon.

Referring now to the drawings, wherein like reference numerals designate corresponding parts throughout the several views, there is shown generally in FIGS. 1, 2, and 3 a portion of a weapon 10 having a fuze 12 mounted flush with the skin 16 of the weapon and extending interiorly of the weapon. Overlying the fuze 12 is a tearable cover 14, much like a "pop-top" can closure, secured by any suitable means to the skin 16 of the weapon.

As can be seen in FIGS. 1–6, the fuze 12 has a cylidrical body 18 with a thickened base 20 having a butterfly-shaped recess 22. A through bore 21 (FIGS. 1 and 2) is formed in the base 20 adjacent to recess 22 to receive a pyrotechnic lead 23 (FIG. 3) as part of the explosive arming train. Approximately diametrically opposite bore 21 is a hole 25 (FIGS. 4–6) which receives a spring-biased stop pin 27, the purpose of which will be described below. The end of fuze body 18 opposite the base 20 is open to slidably receive the safety and arming mechanism and is provided with suitable means of attachment to the weapon, such as screw threads 24.

Figure 5:
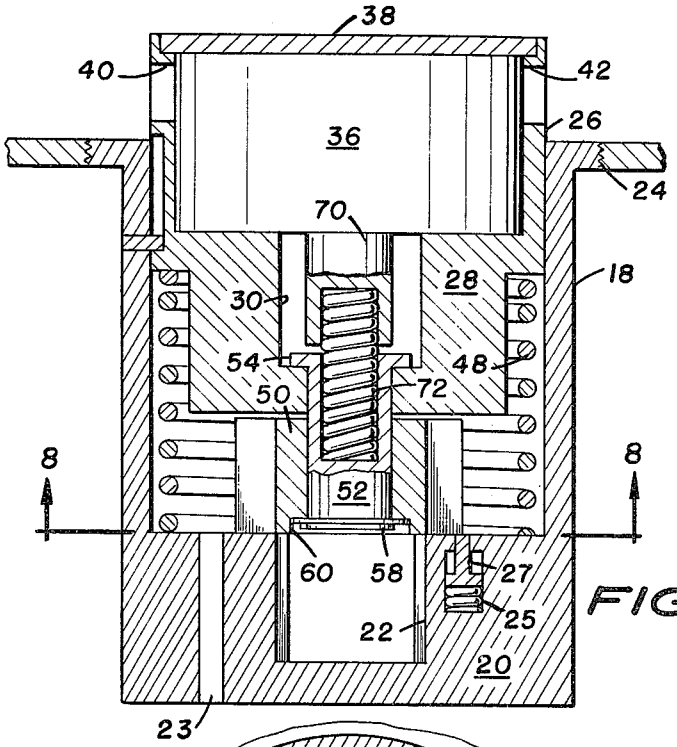
FIGS. 4, 5 and 6 are longitudinal section views of FIGS. 1, 2 and 3, respectively.

The safety and arming mechanism includes a cylindrical housing 26, receivable within the fuze body 18, with a thickened lower portion 28 having a pair of concentric bores 30 and 32, the diameter of bore 32 being somewhat smaller than that of bore 30. Note, particularly, FIGS. 4–6. The upper portion of housing 26 is open, with a cavity 34 to receive the environmental sensor, designated generally as 36, which furnishes the energy necessary to complete arming of the fuze, as will be discussed more fully hereinbelow. A cap 38 closes the cavity 34 after installation of the environmental sensor 36. To provide fluid communication flow through the sensor 36, the upper sidewall of housing 26 is provided with an intake slot 40 and exhaust slot 42 (FIGS. 2 and 5). The sidewall of housing 26, just below the intake slot 40, is provided with an elongated channel 44 which cooperates with a pin 46 protruding from the fuze housing 18 to prevent rotational movement of housing 26, but freely permits sliding, axial displacement out from body 18 of the fuze.

The lower, or base, portion 28 of housing 26 is of reduced diameter, creating an annular chamber to receive a helical spring 48 which biases housing 26 of the safety and arming mechanism upwardly against the cover 14. Rotatably supported below the lower portion 28 is a rotor, or interrupter, 50 having, for example, a butterfly shape to fit within the butterfly-shaped recess 22 in the base 20 of the fuze housing. A rotor axle 52, having, for purposes of illustration, an enlarged, flattened head 54, extends through the bore 32 in the lower portion 28, the head 54 resting on the base of bore 30, and extends through a central bore 56 in rotor 50. Note FIGS. 4–6. A split-ring spring clip 58 slips onto a groove provided on the end of axle 52 and fits within a countersink 60 in the rotor 50 to securely, but rotatably, couple the rotor 50 to the base of housing 26. See FIGS. 7–9. A central bore 53 extends partially into the rotor axle 52 from the head 54.

In one wing of the butterfly-shaped rotor 50 is a through bore 62 containing an electro-responsive explosive device 64, such as a blasting cap, which forms a portion of the explosive train. See FIG. 3. The other wing is provided with another through bore 66 which loosely receives a rectractable rotor locking rod 68, extending partly into the bore 66. Rod 68 is coupled to the environmental sensor 36 and prevents rotation of the rotor 50 into the armed position after the rotor has been axially displaced from the safe position of FIG. 1 and 4 to the deployed, or fuze enabled, position of FIGS. 2 and 5. This will be considered more fully hereinafter.

An arming shaft 70 extends from the environmental sensor 36 and projects into bore 30 in the base of housing 26. A helical spring 72 is connected at one end to the arming shaft 70 and at the other end to the rotor axle 52, the spring 72 being positioned within the central bore 53 provided in the rotor axle and a similar bore 73 provided in the arming shaft 70. As the arming shaft is rotated by the environmental sensor 36, as set forth more fully infra, spring 72 is torqued, storing energy subsequently used to rotate the rotor 50 upon withdrawal of the locking rod 68.

The novel features of the fuze of the present invention, with its dual safe position arming rotor, can be clearly seen from the foregoing description. In the safe position shown in FIGS. 1 and 4, the arming rotor 50, containing the explosive device 64 as a part of the arming train, is doubly out-of-line, both axially and rotationally. To fully arm the fuze, the arming rotor must be permitted to translate axially out from the butterfly-shaped recess 22, as shown in FIGS. 2 and 5, and then be rotated approximately 90° to align the explosive device 64 with the pyrotechnic lead 23. This two-step arming procedure requires a conscious, intentional removal of the tearable cover 14 to permit axial displacement of the rotor and the safety-and-arming device housing. The protrusion of this housing above the surface of the weapon 10 provides an easily-detectable indication, both visually and tactilly, that the arming rotor has been deployed to the enabled position and cautions careful handling. Still, to arm the rotor, the intake and exhaust slots 40 and 42, respectively, must be exposed to the air flow and the necessary rotational energy generated by the environmental sensor 36. This eliminates the hazard of stored potential energy used to arm existing fuzes. Then the locking rod 68 must be withdrawn from the bore 66 to permit the wound helical spring 72 to rotate the rotor into arming alignment. Withdrawal of the rod 68 may be controlled by environmental sensor 36, and the necessary timing sequence initiated by any suitable means known in the art, such as a mechanical timer which is started by the environmental sensor or an electrical timing means activated by electrical energy generated by the sensor. Examples of means to withdraw the rod include mechanical means, such as compressed springs, electrical, magnetic, or electrically-initiated explosive means to expell the rod 68 from bore 66.

Also, because the butterfly-shaped rotor 50 can fit into the similarly-shaped recess 22 in only one of two position, both positions being explosively safe, and because of the close physical and functional proximity between the rotor and environmental sensor 36, the danger of producing an armed fuze or a defective fuze as a result of missing parts or poor assembly has been eliminated. The fuze cannot be properly assembled in the armed condition, and the absence of any component will not inadvertently arm the fuze.

Figure 12:
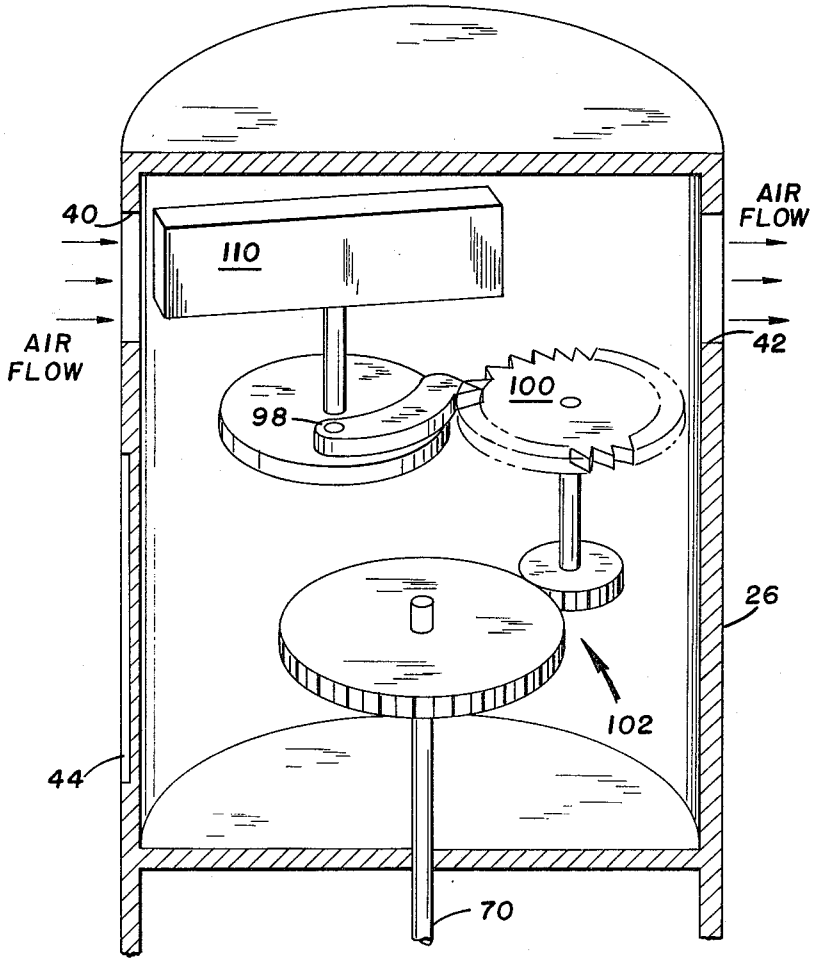
FIG. 12 shows a flutter vane as another alternative environmental sensor.

The environmental sensor 36, an integral part of the arming mechanism, provides the rotary energy to align the explosive components of the arming train. The sensor may be any suitable device activated by air flow. For example, it may be the edgetone generator described in U.S. Pat. No. 3,772,541 to Carl Campagnulo, which senses the existence and speed of an air stream (FIG. 10), an air turbine (FIG. 11) or a flutter vane (FIG. 12). All of these sensors are able to derive energy from the air flow to run an escapement mechanism or other similar devices, or to store energy by winding and holding tension on the spring 72 that will later rotate the rotor 50.

Figure 10:
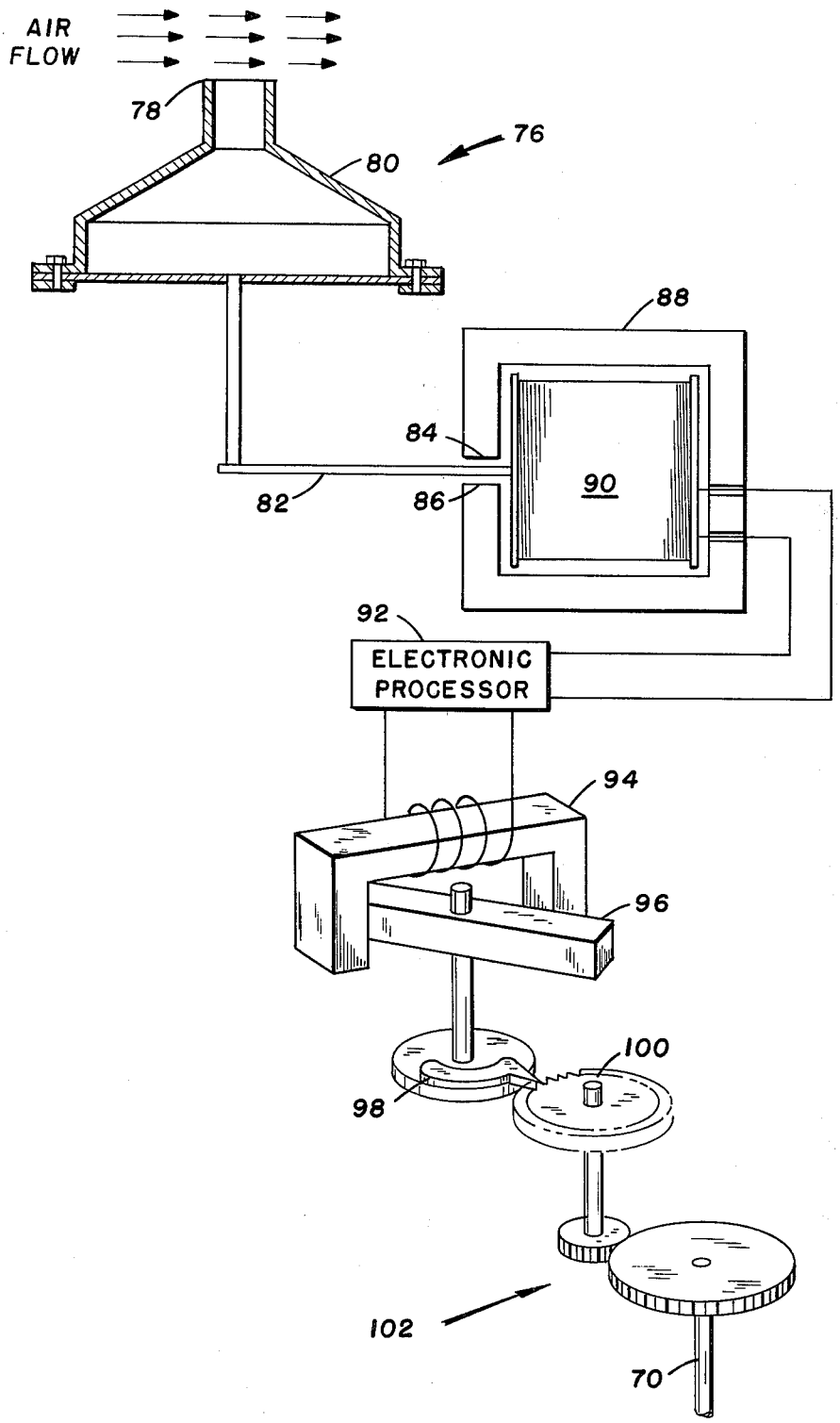
FIG. 10 schematically shows the edgetone generator environmental sensor which provides power to complete fuze arming.

The edgetone generator 76 as an environmental sensor may be as schematically illustrated in FIG. 10 which utilizes the flow of air over a sharp leading edge 78 in a conical resonator chamber 80 to cause resonant vibration of a metal reed 82 interposed between pole pieces 84, 86 of a permanent magnet 88 surrounding an electromagnetic coil 90. The vibrating reed cuts magnetic lines of force to produce an alternating current which may be used to power a mechanism to complete the arming of the fuze. The resulting high-frequency, low amplitude current from the generator 76 is transformed by an electronic processor 92 into a lower-frequency, higher-amplitude current usable to power coil 94. The on-off magnetic field induced in coil 94 causes the adjacent-positioned vane 96 to oscillate, which in turn causes pawl 98, attached to vane 96, to rotate a ratchet wheel 100. A set of speed reduction gears 102 couples the racket wheel to the arming shaft 70. Rotation of shaft 70 winds the helical spring 72, placing it in tension to be subsequently released to arm the fuze. Physically, the edgetone generator 76, including components 78–102 would be completely contained within the environmental generator, generally shown as 36 in FIGS. 4–6, with only the arming shaft 70 extending therefrom, as shown in these same Figures.

Figure 11:
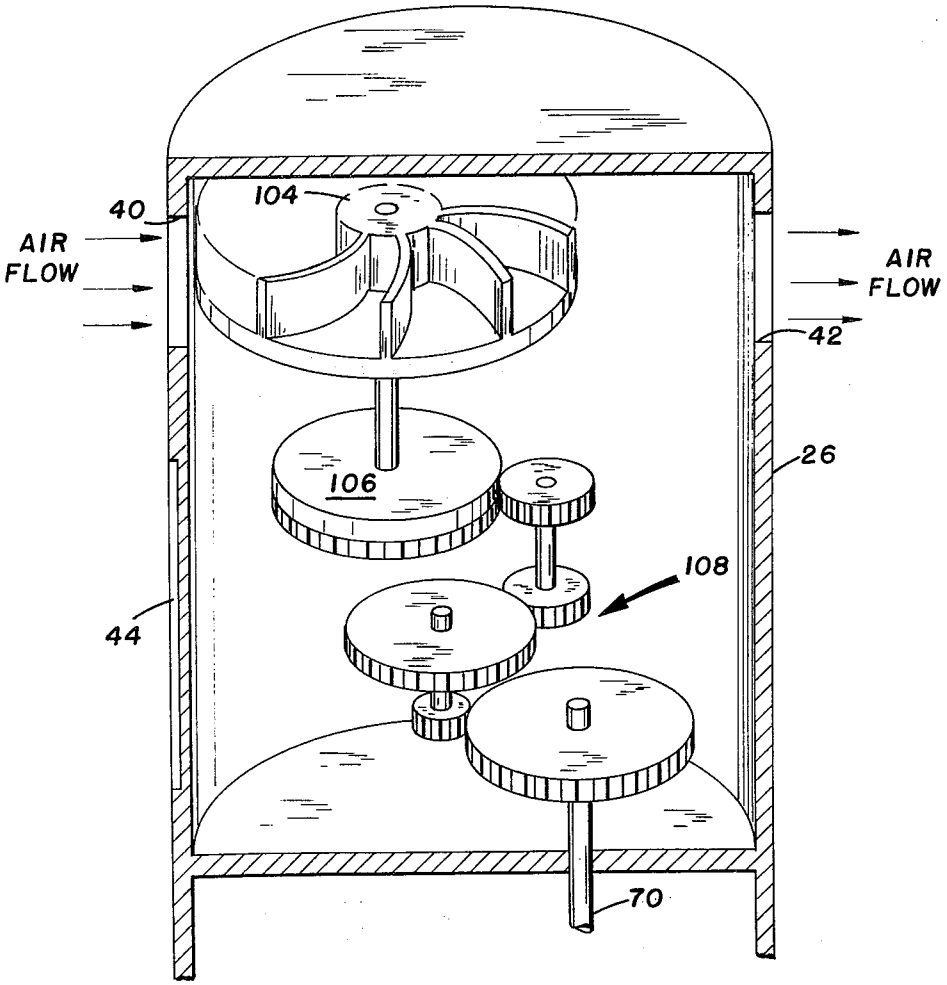
FIG. 11 shows an air turbine as an alternative environmental sensor to provide power for fuze arming.

FIGS. 11 and 12 are illustrative of embodiments of environmental sensors incorporating an air turbine and a flutter vane, respectively. In FIG. 11, an air turbine 104 is positioned in the fluid flow between slots 40, 42 and is coupled to a minimum-flow-velocity governer 106. Reduction gear train 108 reduces the speed and transmits the rotation of turbine 104 to the arming shaft 70. Rotation of shaft 70 relative to the rotor axle 52 places the spring 72 under tension. Release of the spring is subsequently used to arm the fuze, in a manner similar to that applicable to the embodiment of FIG. 10. The embodiment of FIG. 12 utilizes the oscillation of the flutter vane 110, positioned in the fluid flow, to place tension on spring 72 via pawl 98, rachet wheel 100 and the reduction gear train 102. Shaft 70, axle 52 and the spring 72 cooperate in the fashion described above relative to FIGS. 10 and 11.

To prevent undesired movement of vane 96, turbine 104 and flutter vane 110 due to vibrations and rough handling, any means known to those skilled in the art may be employed to hold these elements fixed and to free them after fuze enablement. Similarly, known means may be employed to prevent over-winding of spring 72 by the reduction gear train, such as, for example, properly limiting the number of gear teeth on the rachet wheel 100 and/or the use of slip clutches in the gear train.

Figure 4:
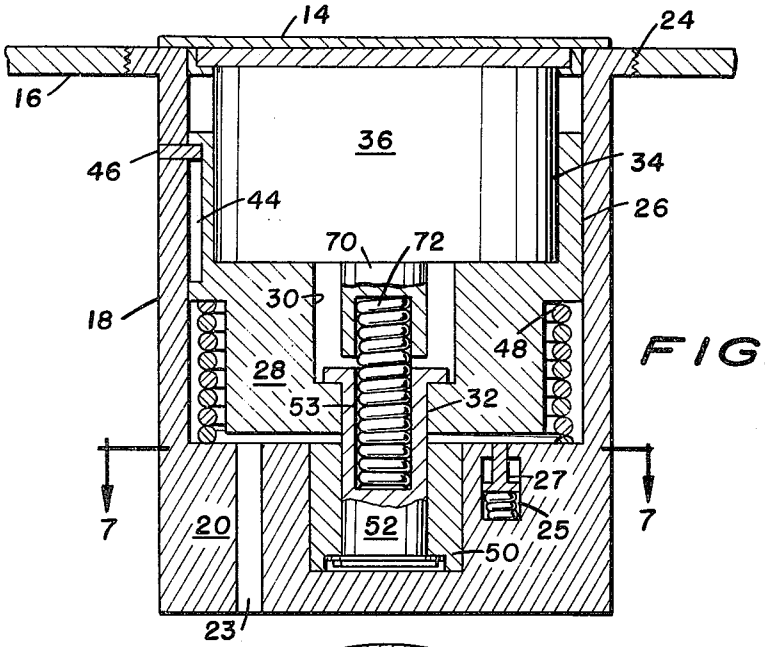
Figure 7:
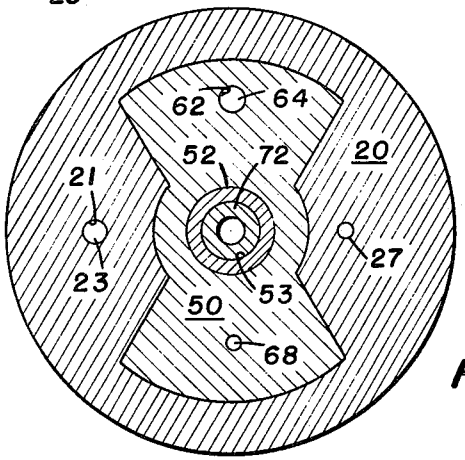

In operation, and as viewed more clearly in FIGS. 1 and 4, the installed fuze 12 has its arming rotor 50 normally in the double-safe, out-of-line position, that is, not yet capable of being armed with the safety-and-arming mechanism housing 26 flush with the skin 16 of the weapon 10. FIG. 7, a view along line 7—7 of FIG. 4 shows the arming rotor 50 positioned in the recess 22, with the explosive device 64 90° out-of-line with the pyrotechnic lead 23. Spring-biased stop pin 27 abuts against the bottom surface of base 28 of housing 26. The locking rod 68 projects from the environmental sensor 36 and extends partially into bore 66. To actuate the fuze 12 and permit it to move to its "enable" or deployed position, the tearable cover 14 is peeled off along a score line circumscribing the fuze's periphery, as by the pull tab and a lanyard attached to the vehicle carrying the weapon 10. This action allows the fuze 12 to rise under the urging of spring 48, as is shown more clearly in FIGS. 2 and 5, thus releasing rotor 50 from the cavity 22 and causing the environmental sensor 36 to protrude into the air stream from the skin 16 of the weapon 10. With the fuze "enabled", it is now capable of being armed once the sensor 36 detects the necessary air stream flow upon delivery of weapon 10. Since the fuze 12 physically protrudes from the weapon, it serves as a cautionary reminder that it has been enabled and this reminder can readily be discerned by visually noting the protruding fuze or by touch if the conditions are such that the fuze is not readily visible.

The rotor 50 is now free to turn, except for being locked by virtue of the rotor rod 68 remaining in the bore 66. When the environmental sensor 36 protrudes into the air stream, air flows into the intake slot 42 and exits from the exhaust slot 44 to operate the environment sensor 36 (see FIGS. 10–12) that produces electrical or mechanical energy. This energy is stored by the arming shaft 70 rotating to wind and hold the rotor spring 72. A timer or other known means, activated when the sensor 36 protruded into the air stream, initiates suitable means to retract the rod 68, completely freeing the rotor 20 to rotate under the force of the rotor spring 40.

Figure 8:
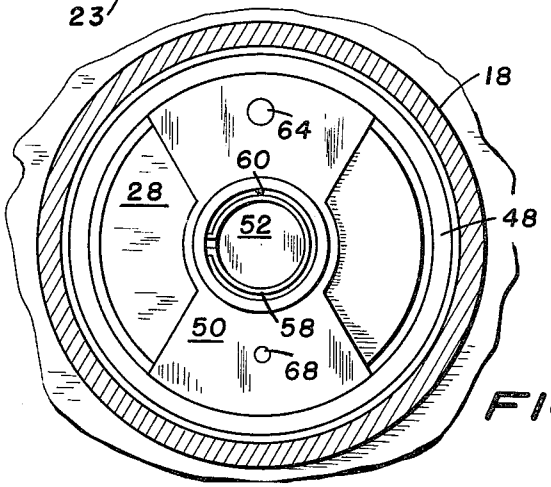
FIGS. 7, 8 and 9 are cross-sectional views taken along lines 7—7, 8—8 and 9—9 of FIGS. 4, 5 and 6, respectively.
Figure 6:
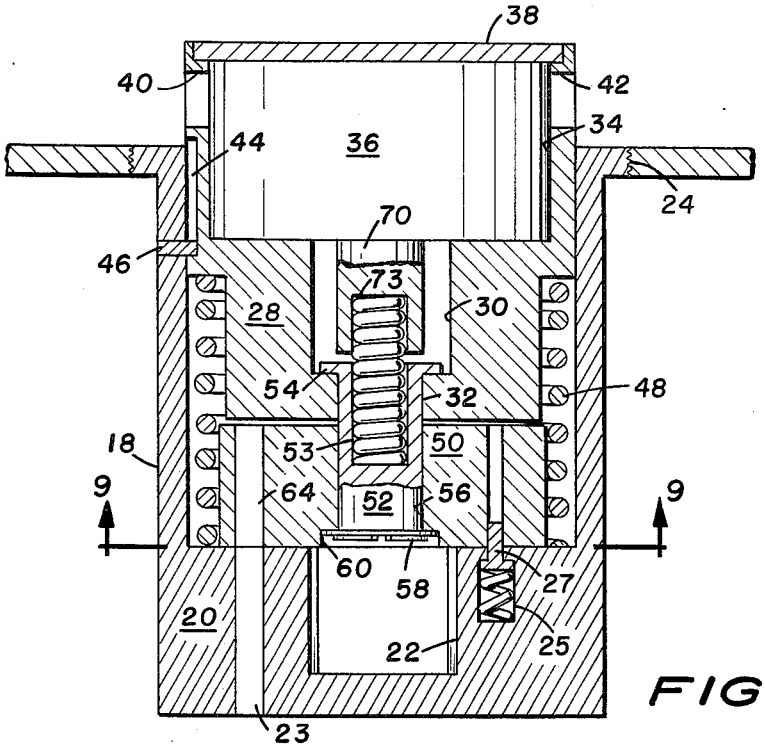
Figure 9:
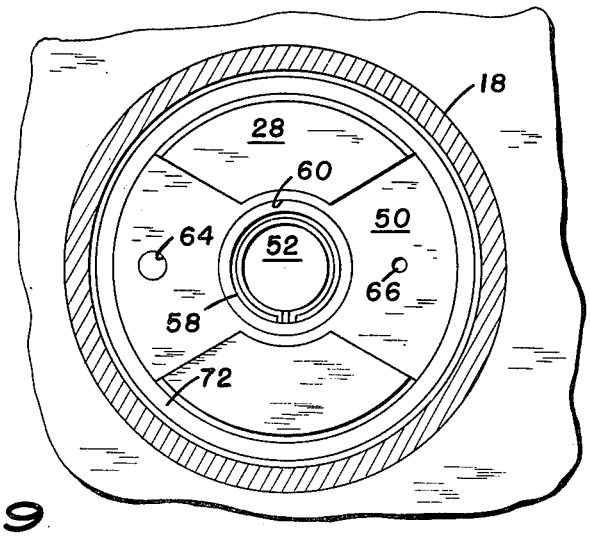

The rotor now turns approximately 90° to align the electro-responsive device 64 with the pyrotechnic lead 23, from the position shown in FIG. 8 to that in FIG. 9, viewed along lines 8—9 and 9—9 of FIGS. 5 and 6, respectively. Proper alignment is insured by the engagement of the stop pin 27 with the bottom of bore 66 (FIG. 6), the pin 7 being held in the "down" position of FIGS. 4 and 5 until rotor 50 has commenced to turn. Means known in the art may be coupled to the rod 68 retracting mechanism to "free" the pin 27, permitting it to project from hole 25 under the force of the spring. The fuze is now fully armed and ready to detonate the weapon 10 when the electro-responsive explosive device 64 is initiated by means known in the art. Accordingly, the desiderata of having no stored energy prior to weapon deployment that can arm the fuze and of having a doubly-safe, out-of-line arming rotor position capable of indicating proper manufacture and safety of the fuze is achieved.

Obviously, many modifications and variations of the present invention are possible in light of the above teachings. It is therefore to be understood that within the scope of the appended claims, the invention may be practiced otherwise than as specifically described.

What is claimed as new and desired to be secured by Letters Patent of the United States is:

1. A safety and arming device for an ordnance fuze comprising:

a housing receivable within the fuze and longitudinally movable from a first position flush with the top surface of the fuze to a second position protruding above the fuze;

an arming rotor rotatably supported on the bottom of and longitudinally movable with said housing;

motive means within said housing to control rotation of said rotor into an armed position only when said rotor is in said second position;

spring means urging said housing and said arming rotor out of said position to said second position;

releasable restraining means for maintaining said rotor and said housing in said first position; and an electro-responsive explosive device positioned in said arming rotor and forming a part of an explosive arming train in the fuze, said rotor being normally held in the safe position with said housing being flush with the fuze and said explosive device being axially and rotationally out-of-line with the explosive arming train.

2. The device of claim 1 further comprising retractable means to prevent rotation of said rotor when said housing is in said second position, and said motive means rotates said arming rotor to align said explosive device with the arming train upon withdrawal of said retractable rotation preventing means.

3. The device of claim 2 wherein said arming rotor has a butterfly shape to be received in a butterfly-shaped recess in the fuze to prevent rotation of said rotor in said first position.

4. The device of claim 3 wherein said motive means to rotate said rotor comprises a sensor responsive to air flow to generate stored energy releasable to rotate said rotor.

5. An ordnance fuze having dual out-of-line safe positions comprising:

a housing adapted to be mounted flush with the surface of the ordnance;

a recess in the base of said housing;

an explosive arming train in the base of said housing adjacent said recess;

a safety and arming device receivable in said housing comprising:

containment means for a source of power, said means longitudinally movable from a first position flush with the surface of the ordance to a second position protruding above the surface of the ordnance; and an arming rotor containing a component of said arming train and rotationally positioned adjacent said containment means, said rotor being receivable in said recess and longitudinally movable with said containment means in said housing from a first axial position with said recess to a second axial position and rotatable only in said second axial position to complete the arming train;

spring means for urging said containment means and said arming rotor out of said first axial position;

releasable restraining means for maintaining said containment means and said rotor in said first axial position; and means in the containment means for rotating said arming rotor in said second axial position to align said arming train in the armed position.

6. The fuze of claim 5 wherein said recess and said rotor are of conforming shapes, said rotor being non-rotatably received in said recess in said first axial position.

7. The fuze of claim 6 further comprising retractable means to prevent rotation of said rotor in said second axial position.

8. The fuze of claim 7 wherein said containment means is provided with openings for fluid communication with the interior of said containment means.

9. The fuze of claim 8 further comprising resilient means adjacent said recess to fix said arming rotor in the armed position after rotation.

10. The fuze of claim 9 wherein said releasable restraining means comprises a tearable cover fastened to the surface of the ordnance and overlying said housing.

11. The fuze of claim 10 wherein said means for rotating said rotor comprises:

an environmental sensor adapted for deriving energy from the environment around the ordnance; and energy storage means operatively coupled to said environmental sensor and said arming rotor.

12. The fuze of claim 11 wherein said energy storage means comprises a torsional spring wound by said environmental sensor to store energy, said torsional spring being released to rotate said arming rotor upon withdrawal of said retractable means.

13. The fuze of claim 12 wherein said environmental sensor comprises:

an edgetone electrical generator responsive to vibrations induced by the air stream to produce electrical energy;

means to convert the electrical energy to mechanical oscillations; and an escapement mechanism operatively coupled to said converter means to torque said torsional spring.

14. The fuze of claim 12 wherein said environmental sensor comprises:

a flutter vane adapted to be oscillation by the air stream; and an escapement mechanism coupled to said flutter vane to torque said torsional spring.

15. The fuze of claim 12 wherein said environmental sensor comprises:

an air turbine rotated by the air stream; and an escapement mechanism coupled to said air turbine to torque said torsional spring.

16. The fuze of claim 12 wherein said arming rotor is butterfly shaped.

17. The fuze of claim 12 wherein said resilient means comprises a spring-biased pin cooperating with an aperture in said arming rotor to prevent continued rotation of said rotor and to align said arming train upon withdrawal of said retractable means.

* * * * *